US007740345B2

(12) United States Patent
Takabe et al.

(10) Patent No.: US 7,740,345 B2
(45) Date of Patent: Jun. 22, 2010

(54) ACTUATOR DEVICE, LIQUID-JET HEAD AND LIQUID-JET APPARATUS

(75) Inventors: Motoki Takabe, Nagano-ken (JP); Koji Sumi, Nagano-ken (JP); Motohisa Noguchi, Nagano-ken (JP); Naoto Yokoyama, Nagano-ken (JP); Takeshi Saito, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 706 days.

(21) Appl. No.: 11/730,644

(22) Filed: Apr. 3, 2007

(65) Prior Publication Data

US 2008/0012911 A1 Jan. 17, 2008

(30) Foreign Application Priority Data

Apr. 3, 2006 (JP) ..... 2006-102352

(51) Int. Cl.
*B41J 2/045* (2006.01)

(52) U.S. Cl. ..... 347/70; 347/68

(58) Field of Classification Search ..... 347/68–72; 310/358

See application file for complete search history.

(56) References Cited

U.S. PATENT DOCUMENTS

2003/0132683 A1* 7/2003 Yamada et al. ..... 310/346
2005/0168524 A1 8/2005 Xin-Shan et al.
2005/0185025 A1* 8/2005 Shimada et al. ..... 347/68
2005/0190239 A1 9/2005 Ito et al.
2008/0034563 A1 2/2008 Xin-Shan et al.

FOREIGN PATENT DOCUMENTS

JP 2000-094681 A 4/2000
JP 2003-096101 A 4/2003
JP 2005-144804 A 6/2005
JP 2005-176433 A 6/2005
JP 2005-228983 A 8/2005

* cited by examiner

*Primary Examiner*—Stephen D Meier
*Assistant Examiner*—Geoffrey Mruk
(74) *Attorney, Agent, or Firm*—Sughrue Mion, PLLC

(57) ABSTRACT

Disclosed is an actuator device which includes a vibration plate and a piezoelectric element. The vibration plate includes an elastic film which is made of silicon oxide ($SiO_2$) and which is formed on a substrate while the piezoelectric element is formed on the vibration plate and including a lower electrode, a piezoelectric layer and an upper electrode. The vibration plate has such a stress as to give a tensile stress between 300 MPa and 500 MPa, inclusive, to the piezoelectric element that is in a state of being displaced.

5 Claims, 4 Drawing Sheets

ACTUATOR DEVICE, LIQUID-JET HEAD AND LIQUID-JET APPARATUS

The entire disclosure of Japanese Patent Application No. 2006-102352 filed Apr. 3, 2006 is expressly incorporated by reference herein.

BACKGROUND

1. Technical Field

The present invention relates to an actuator device equipped with a vibration plate provided on a substrate and with a piezoelectric element formed on the vibration plate. The invention also relates to a liquid-jet head and a liquid-jet apparatus both of which employ the actuator device mentioned above.

2. Related Art

A type of actuator device in which displacement of a vibration plate is caused by drive of a piezoelectric element is mounted on, for example, a head that jets a liquid (liquid-jet head, for short). A well-known example of the liquid-jet head is an ink-jet recording head in which actuator devices are provided on a passage-forming substrate where pressure-generating chambers communicating respectively with nozzle orifices are formed. When the actuator devices are driven, the ink-jet head ejects ink droplets. Put another way, the vibration plate forms a part of each pressure-generating chamber in the ink-jet recording head and is deformed by driving the corresponding piezoelectric element. When the vibration plate deforms, the ink in the pressure-generating chamber is pressurized, and ink droplets are ejected through the corresponding nozzle orifice. A type of actuator device that can be mounted on the ink-jet recording head of the above-mentioned kind is disclosed in, for example, JP-A-2000-094681. In the actuator device, a piezoelectric layer made of, for example, a thin film of PZT is evenly formed on the entire surface of the vibration plate by a film-forming method, and then the piezoelectric layer is cut into shapes, each of which corresponds to each one of pressure-generating chambers by a lithography method. The piezoelectric elements thus formed are independent of one another and correspond to pressure-generating chambers, respectively.

SUMMARY

An advantage of such an actuator device equipped with thin-film piezoelectric elements is its capability of arranging piezoelectric elements in a higher density. The actuator device when mounted on an ink-jet recording head, improves the quality of printing. This kind of actuator device, however, has problems. For example, as the piezoelectric element is driven repeatedly, the ink-ejection characteristics gradually deteriorate. The degradation occurs due to the remnant polarization of the piezoelectric layer which causes a decrease in the amount of displacement of the piezoelectric element (i.e. the amount of displacement of the vibration plate). In the initial stage, in particular, the amount of displacement of piezoelectric element changes significantly.

An advantage of the some aspects of the invention is to provide an actuator device equipped with a piezoelectric element in which the decrease in the amount of displacement is prevented. Also provided are a liquid-jet head and a liquid-jet apparatus with the same features.

A first aspect of the invention provides an actuator device that includes a vibration plate and a piezoelectric element. The vibration plate includes an elastic film which is made of silicon oxide ($SiO_2$), and which is formed on a substrate. The piezoelectric element is formed on the vibration plate, and includes a lower electrode, a piezoelectric layer and an upper electrode. In the actuator device, the vibration plate has such a stress as to give a tensile stress between 300 MPa and 500 MPa, inclusive, to the piezoelectric element that is in a displaced state.

According to the first aspect of the invention, the tensile stress given by the vibration plate restores the piezoelectric element in a deflected state to the original state, that is, a state in which there is substantially no flexure deformation. As a result, even when the piezoelectric element is repeatedly driven, decrease in the amount of displacement of the piezoelectric element (the amount of displacement of the vibration plate) is prevented.

A second aspect of the invention provides the actuator device of the first aspect with the following additional features. The vibration plate further includes an insulation film. The insulation film is made of zirconium oxide ($ZrO_2$), and has a thickness of not more than 1600 nm. Meanwhile, the elastic film is more than three times as thick as the insulation film.

According to the second aspect, the vibration plate has a tensile strength within the above-mentioned range with certainty. Meanwhile, the relatively thin vibration plate enables the piezoelectric element to be driven at a high-speed.

A third aspect of the invention provides the actuator device according to the second aspect, in which actuator device the vibration plate has a thickness in a range between 1300 nm and 1400 nm.

According to the third aspect, the piezoelectric element is capable of being driven at a high-speed with more certainty while the tensile strength of the vibration plate remains within the above-mentioned range.

A fourth aspect of the invention provides the actuator device according to any one of the first to third aspects that further includes a protective film made of an inorganic insulation material and provided on the piezoelectric element, while the protective film coats the piezoelectric element.

According to the fourth aspect, the protective film prevents the moisture from damaging the piezoelectric element. In addition, the prevention of the decrease in the amount of displacement of the piezoelectric element is still accomplished even with the protective film being formed.

A fifth aspect of the invention provides a liquid-jet head that includes the actuator device according to any one of the first to fourth aspects. The actuator device serves as a pressure-generating unit that generates, in a pressure-generating chamber formed on the substrate, pressure to jet a liquid from a nozzle orifice.

According to the fifth aspect of the invention, a liquid-jet head in which favorable ejection characteristics are always obtainable is provided.

A sixth aspect of the invention provides a liquid-jet apparatus that includes the liquid-jet head of the fifth aspect.

According to the sixth aspect of the invention, a highly reliable and durable liquid-jet apparatus is provided.

DESCRIPTION OF EXEMPLARY EMBODIMENTS

What follows is a detailed description of the invention by way of embodiments.

Figure 1:
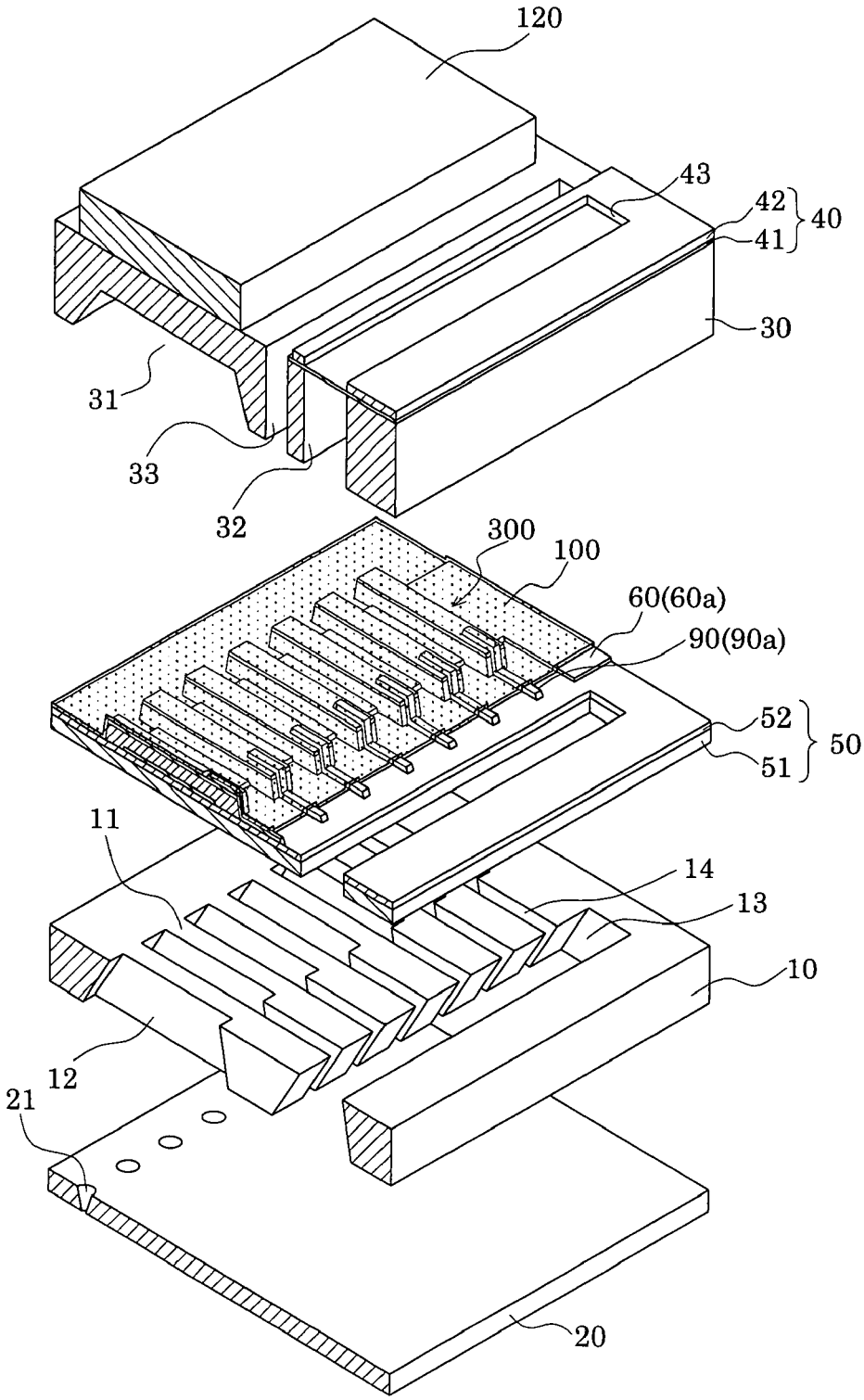
FIG. 1 is an exploded, perspective view of a recording head according to an embodiment.
Figure 2A:
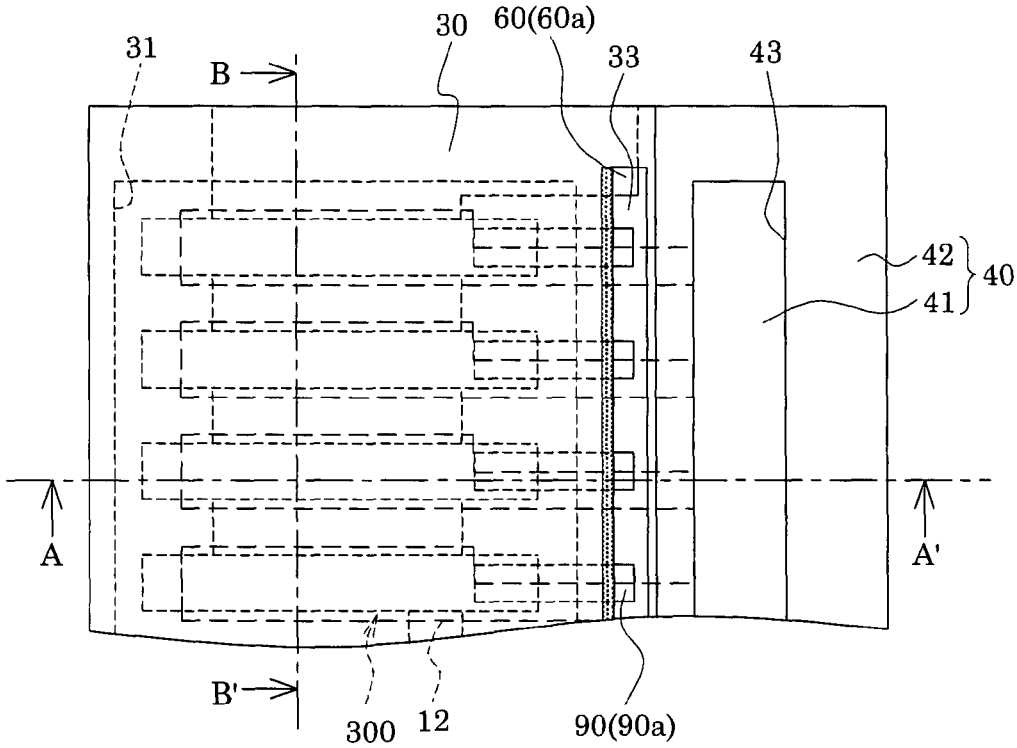
FIG. 2A is a plan view of the recording head according to an embodiment and FIG. 2B is a cross-sectional view of the recording head according to an embodiment.
Figure 3:
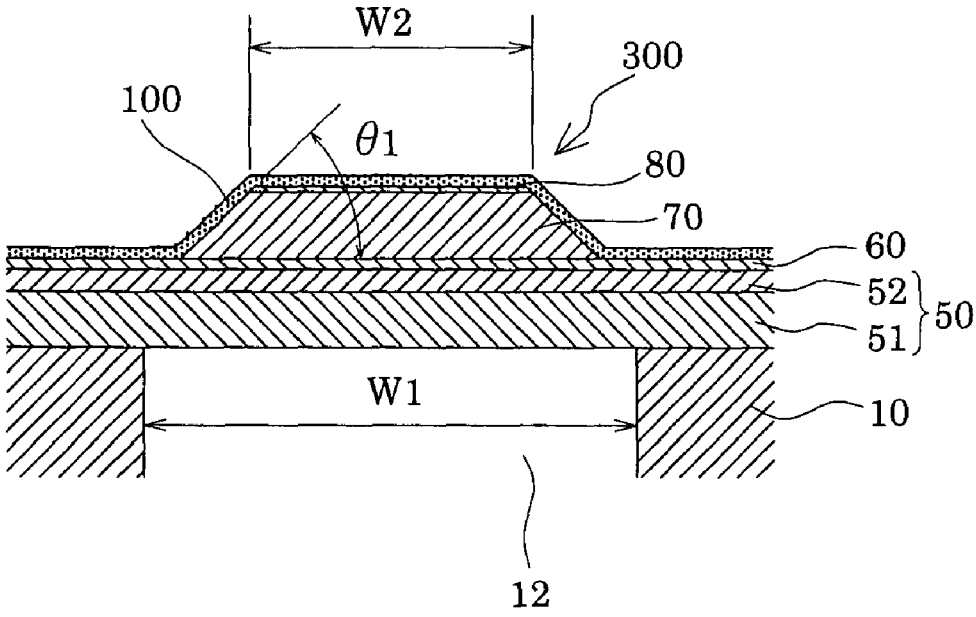
FIG. 3 is a cross-sectional view of a portion corresponding to an actuator device according to an embodiment.

FIG. 1 is an exploded, perspective view showing an ink-jet recording head according to an embodiment of the invention. FIG. 2A is a plan view of the ink-jet recording head, and FIG. 23 is a cross-sectional view of the ink-jet recording head taken along the line A-A' of FIG. 2A. FIG. 3 is an enlarged cross-sectional view of a portion corresponding to an actuator device, taken along the line B-B' of FIG. 2A. These figures show the following configuration. A passage-forming substrate 10 is a single-crystal silicon substrate in the (110) orientation in this embodiment. A plurality of pressure-generating chambers 12 are formed in the substrate 10, and arranged side by side along the width (lateral) direction of each chamber 12. A vibration plate 50, which includes an elastic film 51, is formed at a surface side of the passage-forming substrate—detailed descriptions of the vibration plate 50 will be given later. The vibration plate 50 (elastic film 51) constitutes a surface-wall of the pressure-generating chamber 12. In the passage-forming substrate 10, a communicating portion 13 is formed in a region outside the pressure-generating chambers 12 in the longitudinal direction of each of the pressure-generating chambers 12. An ink supply path 14 provided for each pressure-generating chamber 12 allows the communication portion 13 and the corresponding pressure-generating chamber 12 to communicate with each other. By communicating with a reservoir portion 32 of a protective plate 30 the communication portion 13 composes a part of a reservoir 110, which is to be a common ink chamber for the pressure-generating chambers 12. The ink supply path 14 is formed to be narrower than each pressure-generating chamber 12, and maintains, at a constant level, the passage resistance of the ink flowing into the pressure-generating chamber 12 from the communicating portion 13.

A nozzle plate 20 having nozzle orifices 21 drilled therein is fixed to a surface side of the passage-forming substrate 10 with adhesive agent, a thermal adhesive film and the like interposed in between. The nozzle orifices 21 communicate respectively with vicinities of the opposite ends of the pressure-generating chambers 12 to the corresponding ink supply paths 14. The nozzle plate 20 is made of glass ceramic, a single-crystal silicon substrate, stainless steel or the like.

On the side opposite to the side where nozzle plate 20 of the passage-forming substrate 10 is located, the elastic film 51 is formed, while an insulation film 52 is formed on this elastic film 51. The elastic film 51 and the insulation film 52 together constitute the vibration plate 50. Additionally, piezoelectric elements 300 are formed on this vibration plate 50. A lower electrode film 60, a piezoelectric layer 70 and an upper electrode film 80 constitute each piezoelectric element 300. Generally, in the configuration of the piezoelectric element 300, any one of the two electrodes of the piezoelectric element 300 serves as a common electrode, while the other one of these electrodes and the piezoelectric layer 70 are patterned for each pressure-generating chamber 12. In this embodiment, the lower electrode film 60 serves as the common electrode to the piezoelectric elements 300, and the upper electrode film 80 serves as individual electrodes of the respective piezoelectric elements 300. However, the roles of the two electrode films may be reversed to meet the needs for the drive circuit and the wiring. Here, the piezoelectric element 300 and the vibration plate where displacement occurs when the piezoelectric elements 300 are driven constitute a unit called an actuator device.

As described in the above example, the vibration plate 50 forming a part of the actuator device includes the elastic film 51 and the insulation film 52. For example, the elastic film 51 of the vibration plate 50 in this embodiment is made of silicon oxide ($SiO_2$), and has a thickness of approximately 1000 nm. The elastic film 51 is formed through a thermal oxidization of the passage-forming substrate 10. Meanwhile, the insulation film 52 of the vibration plate 50 in this embodiment is made of zirconium oxide ($ZrO_2$), and has a thickness of approximately 400 nm.

The stress of the vibration plate 50 according to this embodiment of the invention is such that a tensile stress from 300 MPa to 500 MPa, inclusive, generates in the piezoelectric element 300 in the state of being displaced when a voltage is applied to the piezoelectric element 300. In other words, a force acts on the piezoelectric element 300 in the state of being displaced by an application of a voltage, and the force makes the displaced piezoelectric element 300 return the original state with help of the vibration plate 50. Thanks to the forcer the piezoelectric element 300 restores the state substantially without displacement. For this reason, even when the piezoelectric element is repeatedly driven, the decrease in the amount of displacement of the piezoelectric element (the amount of displacement of the vibration plate) is prevented. When the tensile stress given to the piezoelectric element 300 by the vibration plate 50 is smaller than 300 MPa, the prevention of the decrease in the amount of displacement of the piezoelectric element 300 may sometimes fail. Meanwhile a tensile stress of more than 500 MPa may possibly cause a warpage or even a crack in the passage-forming substrate 10.

To make the stress of the vibration plate 50 within the above-mentioned range, the thickness of the vibration plate 50 is preferably not more than 1600 nm, and, at the same time, the elastic film 51 is preferably formed to be not less than three times as thick as the insulation film 52. A thickness of 1300 nm to 1400 nm is especially preferable for the vibration plate 50. Accordingly, the vibration plate 50 certainly has a stress within the above-mentioned range, meanwhile the relatively thin—not more than 1600 nm—vibration plate allows a high-speed driving of the piezoelectric element 300.

The piezoelectric elements 300 formed on the vibration plate 50 correspond to the pressure-generating chambers 12, respectively. As FIG. 3 shows, each piezoelectric element 300 is formed to be narrower than the pressure-generating chamber 12, and to be located within a region corresponding to the pressure generating chamber 12 at least in the lateral direction of the pressure-generating chamber 12. Note that the pressure-generating chamber 12 in this embodiment is formed to have a width W1 being equal to approximately 55 μm.

The lower electrode film 60, which forms a part of the piezoelectric element 300, is made of, for example, a metal material such as platinum (Pt), iridium (Ir). The lower electrode film 60 in this embodiment is formed of a layer of platinum and a layer of iridium in a thickness of approximately 150 nm. Examples of the material that the piezoelectric layer 70 is made of include a ferroelectric piezoelectric material such as lead-zirconate-titanate (PZT), and a relaxor ferroelectrics made by adding a metal such as niobium, nickel, magnesium, bismuth and ytterbium to a ferroelectric piezoelectric material. The piezoelectric layer 70 in this embodiment is formed of a layer of lead-zirconate-titanate (PZT) in a thickness of approximately 1100 nm. The upper electrode film 80, as in the case of the lower electrode film 60, is made of a metal material such as platinum (Pt), iridium (Ir).

The upper electrode film 80 in this embodiment is formed of a layer of iridium in a thickness of approximately 50 nm.

Layers or the piezoelectric layer 70 and the upper electrode film 80, each of which forms a part of the piezoelectric element 300, are formed, by a sputtering method or the like, sequentially on the lower electrode film 60 having been patterned into a predetermined shape. The piezoelectric layer 70 and the upper electrode film 80 are then subjected to patterning together. The piezoelectric layer 70 and the upper electrode film 80 in this embodiment are formed in a substantially trapezoidal cross-sectional shape with the width of these gradually increasing from the side of the upper electrode film 80 to the side of the lower electrode film 60. Specifically, as shown in FIG. 3, the piezoelectric layer 70 and the upper electrode film 80 are formed so that the inclination angle θ1 that each of inclined surfaces located on the two sides in the lateral direction makes with the bottom face can be approximately 30°. Meanwhile the width W2 of the piezoelectric layer 70 on the side of the upper electrode film 80 is made to be approximately 40 μm.

Figure 2B:
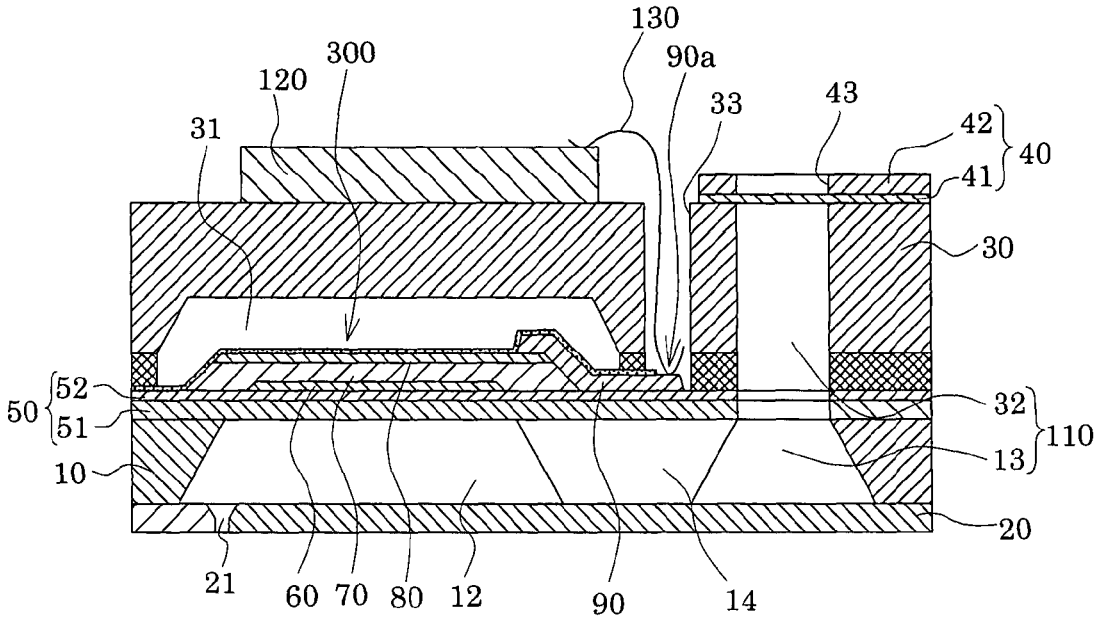

A lead electrode 90 is connected with the upper electrode film 80 of each piezoelectric element 300. The lead electrode 90 is drawn out from the upper electrode film until the lead electrode 90 reaches the region facing the ink supply path 14 (see, FIG. 2).

The piezoelectric element 300 and the lead electrode 90 in this embodiment are coated with a protective film 100 made of an inorganic insulation material, except the regions facing a connector portion 60*a* of the lower electrode film 60 and facing a connector portion 90*a* of the lead electrode 90. An example of preferable materials for the protective film 100 is aluminum oxide ($Al_2O_3$). This is because the protective film 100 is provided for the purpose of preventing moisture and the like in the air from damaging the piezoelectric element, and aluminum oxide has extremely low moisture permeability. The protective film 100 preferably has a thickness of approximately 100 nm. With this thickness, the protective film 100 satisfactorily prevents the moisture from permeating even under a high-humidity environment, and also prevents the decrease in the amount of displacement of the vibration plate 50.

Furthermore, a protective plate 30 including a piezoelectric element holding portion 31 is joined, by an adhesive agent or the like, onto a surface of the passage-forming substrate 10, on which surface the piezoelectric elements 300 are formed. The piezoelectric elements 300 are formed inside the piezoelectric element holding portion 31, so that the piezoelectric elements 300 are protected as being practically uninfluenced by the outside environment. A reservoir portion 32 is formed in the protective plate 30 in a region facing the communicating portion 13 of the passage-forming substrate 10. As has been described above, this reservoir portion 32 is allowed to communicate with the communicating portion 13 of the passage-forming substrate 10. The reservoir portion 32 and the communicating portion 13 thus constitute a reservoir 110, which is a common ink chamber to the pressure-generating chambers 12. A connecting hole 33, which penetrates the protective plate 30 in the thickness direction thereof, is formed in a region of the protective plate 30 between the piezoelectric element holding portion 31 and the reservoir portion 32. The above-mentioned connector portions 60*a* and 90*a* respectively of the lower electrode film 60 and of the lead electrode 90 are exposed inside the connecting hole 33. The connector portions 60*a* and 90*a*, respectively, of the lower electrode film 90 and of the lead electrode 90*a* are electrically connected to an end of a connection wiring 130 while the other end of the connection wiring 130 is connected to a driving IC 120 mounted on the protective plate 30.

A compliance plate 40, composed of a sealing film 41 and a fixing plate 42, is joined onto the protective plate 30. The sealing film 41 is made of a flexible material with a low rigidity while the fixing plate 42 is made of a hard material such as a metal. In the fixing plate 42, a region facing the reservoir 110 is formed into an opening portion 43 by completely removing the fixing plate 42 in the thickness direction thereof. Accordingly, only the flexible sealing film 41 seals one direction of the reservoir 110.

An ink-jet recording head of this embodiment takes in ink from unillustrated external ink supplying method, and the inside of the components from the reservoirs 110 to the nozzle orifices 21 is filled with the ink. Then, a voltage is applied between the lower electrode film 60 and each of the upper electrode films 80, which correspond to each of the pressure-generating chambers 12, in response to a recording signal from the driver IC 120. With the application of the voltage, the piezoelectric layer 70 is deflected to deflect, in turn, the vibration plate 50 (the elastic film 51 and the insulation film 52). As a consequence, the pressure in each of the pressure-generating chambers 12 increases to make the ink be ejected from the nozzle orifices 21.

As has been described thus far, the vibration plate 50 according to this embodiment of the invention has such a stress as to generate a tensile stress from 300 MPa to 500 MPa, inclusive, in the piezoelectric element 300 in the state of being displaced when a voltage is applied to the piezoelectric element 300. Such a stress of the vibration plate 50 prevents the decrease in the amount of displacement of the piezoelectric element 300 even with repeated drives of the piezoelectric element 300. As a result, stable ejection of the ink droplets is always accomplished, so that the quality of printing maintains a favorable level for a long time.

Figure 4:
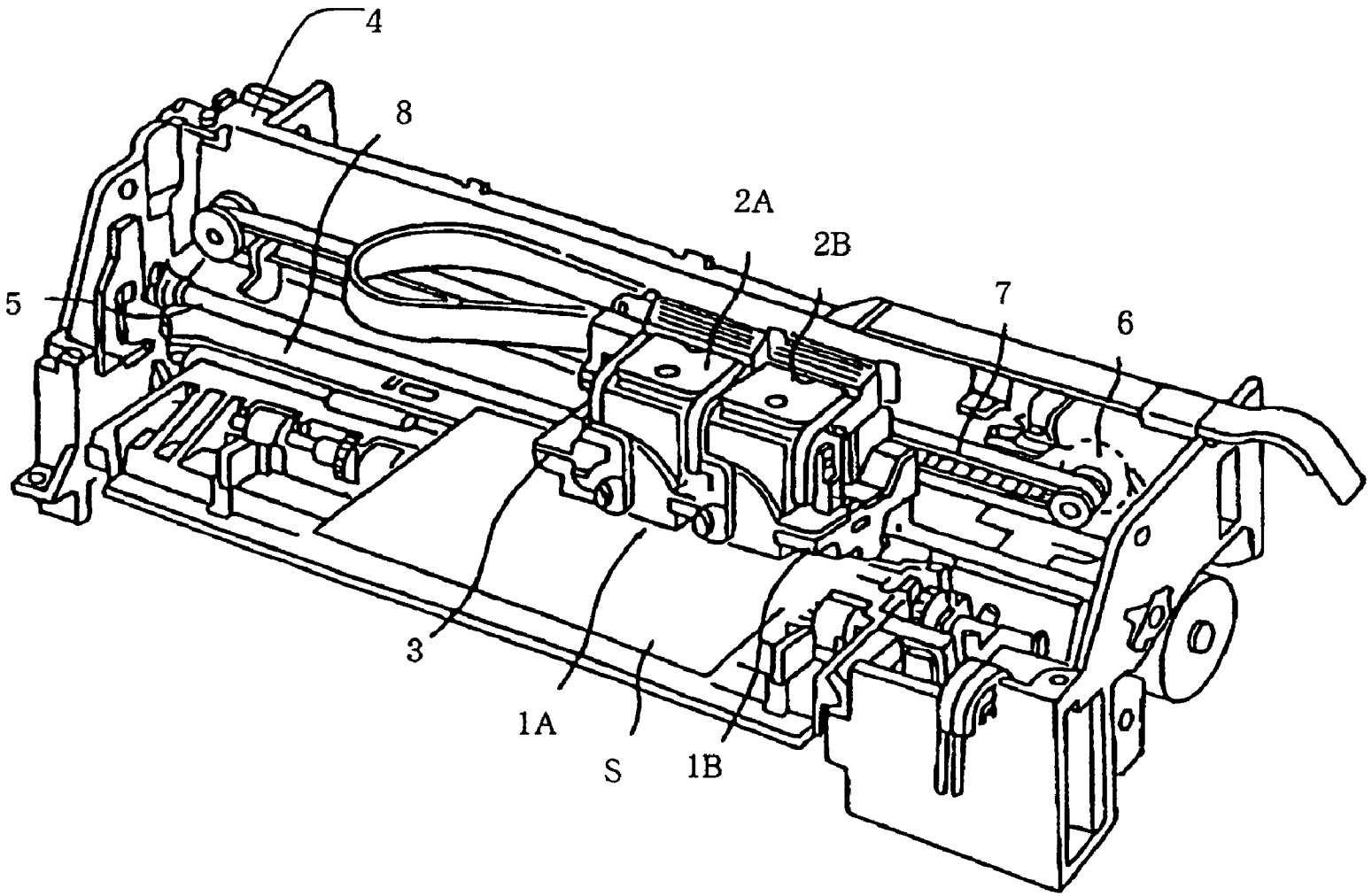
FIG. 4 is a schematic perspective view of a recording apparatus according to an embodiment.

An embodiment of the invention has been described thus far, but the invention is not limited to the embodiment that has been described. The kind of ink-jet recording head forms a part of a recording head unit with an ink passage formed therein and connecting with an ink cartridge and the like. The ink-jet recording head thus constructed is mounted on an ink-jet recording apparatus. FIG. 4 is a schematic perspective view of an example of the ink-jet recording apparatus. As shown in FIG. 4, a cartridge 2A and a cartridge 2B, which constitute ink supplying method, are detachably provided respectively to recording head units 1A and 2A each including an ink-jet recording head. A carriage 3 having the recording head units 1A and 1B mounted thereon is provided on a carriage shaft 5 in a state freely movable along the axial direction of the carriage shaft 5 while the carriage shaft 5 is fixed to an apparatus body 4. These recording head units 1A and 1B are, for example, configured to eject a black ink composition and a color ink composition, respectively. When the driving force of a drive motor 6 is transmitted to the carriage 3 through a plurality of unillustrated gears and a timing belt 7, the carriage 3 having the recording head units 1A and 1B mounted thereon moves along the carriage shaft 5. In addition, a platen 8 is provided along the carriage shaft 5 in the apparatus body 4. A recording sheet S, which is a recording medium such as paper fed by an unillustrated feed roller or the like, is conveyed by being wound around the platen 8.

Furthermore, the above embodiment has been described by taking the ink-jet recording head as an example of a liquid-jet head. The basic configuration of the liquid-jet head is not limited to the above-described purpose. The target of the invention is so broad as to include liquid-jet heads at large. It is, for this reason, obviously possible to apply the invention to a liquid-jet head that ejects a liquid other than ink. Examples of liquid-jet heads that eject a liquid other than ink include: various recording heads used for image recording apparatuses such as a printer; a color-material-jet head used for manufacturing color filters of a liquid crystal display and the like; an electrode-material-jet head used for forming electrodes of an organic EL display, a field emission display (FED) and the like; a bio-organic-matter-jet head used for manufacturing biochips.

In addition, the invention is applicable not only to an actuator device mounted on a liquid-jet head such as an ink-jet recording head, but is also applicable to actuator devices mounted on apparatuses of all kinds

The invention claimed is:

1. An actuator device comprising: a vibration plate including an elastic film which is made of silicon oxide ($Si0_2$) and which is formed on a substrate; and a piezoelectric element formed on the vibration plate and including a lower electrode, a piezoelectric layer, and an upper electrode, wherein the vibration plate has such a stress as to give a tensile stress between 300 MPa and 500 MPa, inclusive, to the piezoelectric element that is in a state of being displaced, wherein the vibration plate further includes an insulation film made of zirconium oxide ($Zr0_2$), and the insulation film has a thickness of not more than 1600 nm, while the elastic film is more than three times as thick as the insulation film.

2. The actuator device according to claim 1 wherein the vibration plate has a thickness in a range between 1300 nm and 1400 nm.

3. The actuator device according to claim 1 further comprising a protective film made of an inorganic insulation material and provided on the piezoelectric element, the protective film coating the piezoelectric element.

4. A liquid-jet head comprising an actuator device according to claim 1 as a pressure-generating unit configured to generate, in a pressure-generating chamber formed on the substrate, pressure to jet a liquid from a nozzle orifice.

5. A liquid-jet apparatus comprising a liquid-jet head according to claim 4.

* * * * *